US006872176B2

(12) United States Patent
Wyss et al.

(10) Patent No.: US 6,872,176 B2
(45) Date of Patent: Mar. 29, 2005

(54) DEVICE FOR UNFOLDING OF FOLDED BOXES

(75) Inventors: Thomas Wyss, Lich (DE); Walter Baur, Gruendau (DE)

(73) Assignee: Rovema Verpackungsmaschinen GmbH, Fernwald (DE)

( * ) Notice: Subject to any disclaimer, the term of this patent is extended or adjusted under 35 U.S.C. 154(b) by 0 days.

(21) Appl. No.: 10/081,140

(22) Filed: Feb. 22, 2002

(65) Prior Publication Data

US 2002/0119879 A1 Aug. 29, 2002

(30) Foreign Application Priority Data

Feb. 23, 2001 (DE) ..... 101 08 951

(51) Int. Cl.[7] ..... B31B 1/88
(52) U.S. Cl. ..... 493/55; 493/123; 493/315
(58) Field of Search ..... 493/55, 309, 313, 493/123, 310, 315, 316, 319

(56) References Cited

U.S. PATENT DOCUMENTS 3,888,164 A * 6/1975 Taddei ..... 493/316
4,197,790 A * 4/1980 Dietrich et al. ..... 493/313
4,232,591 A * 11/1980 Karpinsky ..... 493/314
4,537,587 A * 8/1985 Langen ..... 493/315
4,871,348 A * 10/1989 Konaka ..... 493/315
5,054,761 A 10/1991 Dietrich et al.
5,061,231 A * 10/1991 Dietrich et al. ..... 493/315
5,078,669 A * 1/1992 Dietrich et al. ..... 493/315
5,207,630 A * 5/1993 Decker et al. ..... 493/313
5,411,464 A * 5/1995 Calvert et al. ..... 493/315
5,509,257 A 4/1996 Tagliaferri et al.
5,562,581 A * 10/1996 Roberto et al. ..... 493/310
5,573,490 A 11/1996 Steinbrenner et al.
5,588,643 A * 12/1996 Tagliaferri et al. ..... 271/35
5,662,577 A * 9/1997 Reuteler ..... 493/315
5,715,657 A * 2/1998 Mondani et al. ..... 53/457
5,782,734 A * 7/1998 Reuteler ..... 493/313
5,910,078 A * 6/1999 Guttinger et al. ..... 493/309
6,306,070 B1 * 10/2001 Herrin ..... 493/125
6,659,928 B2 12/2003 Baumeister et al.

FOREIGN PATENT DOCUMENTS

AU 81636/75 12/1976
GB 1 152 321 5/1969

* cited by examiner

*Primary Examiner*—Eugene Kim
*Assistant Examiner*—Paul Durand
(74) *Attorney, Agent, or Firm*—Flynn, Thiel, Boutell & Tanis, P.C.

(57) ABSTRACT

A device for unfolding of folded boxes, comprising a magazine for receiving of flat folded-box sleeves, a removing device for the individual removal of the folded-box sleeves from the magazine and for feeding the folded-box sleeves to an unfolding station where the folded-box sleeves are partially unfolded along a compressing section. The unfolding device has after the compressing section a chute for the precisely fitting receipt of the partially unfolded folded-box sleeves, an output device to remove the folded-box sleeves from the chute, and an expansion chamber following the chute for receiving the fully unfolded folded-box sleeves in order to achieve a very high unfolding rate.

18 Claims, 1 Drawing Sheet

DEVICE FOR UNFOLDING OF FOLDED BOXES

FIELD OF THE INVENTION

The invention relates to a device for unfolding of folded boxes, comprising a magazine for receiving of flat folded-box sleeves, a removing device for the individual removal of the folded-box sleeves from the magazine and for feeding the folded-box sleeves to an unfolding device where the folded-box sleeves are unfolded along a compressing section.

BACKGROUND OF THE INVENTION

Folded-box blanks made out of cardboard and glued to form sleeves are unfolded with such a device by applying a compressing pressure onto opposite edges of the folded-box sleeves. When unfolding a flat folded-box sleeve, its cross section is changed into a rectangle. The bottom-side face of the folded box is subsequently glued and closed off, the folded box is filled, for example, with a tubular bag, and finally the top-side face is glued and closed off.

Devices are known for unfolding the folded box fully through mechanical pressure along a compressing section, namely until right inner angles exist at all four edges of the folded-box sleeve. Only then is the folded-box sleeve moved on or further processed. The full unfolding, however, takes relatively long. This time requirement is disadvantageous for relatively quick packaging operations.

The purpose of the invention is to avoid a relatively long time for the full mechanical unfolding of a folded-box sleeve and yet achieve fully unfolded folded-box sleeves.

SUMMARY OF THE INVENTION

The purpose is attained by providing a chute following the compressing section for the precisely fitting receipt of the folded-box sleeves which are only partially unfolded at the compressing section, which chute has an output device for removing the partially unfolded folded-box sleeves from the chute, and an expansion chamber following the chute to receive the fully unfolded folded-box sleeves.

The device of the invention has the advantage that a full mechanical unfolding along the compressing section is avoided so that the compressing operation occurs in a shortened time. The precisely fitting receipt in the chute serves, on the one hand, for the partially unfolded folded-box sleeves to be held for a specific time in their unfolded position in order to permit the sleeve material to compensate through suitable forces for the earlier quick unfolding and the related stresses. On the other hand, the chute prevents an independent, full unfolding of the folded-box sleeve, as it would be possible from the there existing material stress. The folded-box sleeves are, after leaving the chute, in a state which results in the expansion chamber in a full unfolding of the folded-box sleeves. The expansion chamber does not have any limitation corresponding to the boundary specified in the chute. Due to the relatively great time savings, since only a partial unfolding occurs along the compressing section, there results a time advantage for the last to occur full unfolding, which time advantage enables a very high unfolding rate (sleeves per second). This rate results from the inertia forces of the flat folded-box sleeves being subjected to a reduced sum of compressing forces along the compressing section. The operation of the chute is optimal in particular at a very high unfolding speed.

When the removing device has several arms each with a suction head, and the arms can be moved by a drive and a planetary gearing along a cycloidal path, it is then possible in a technically simple manner to remove at a top of the cycloidal path a flat folded-box sleeve by means of a suction head from the magazine, and to place same into the chute at another top. The partial unfolding through compressing can then occur along a curve of the cycloidal path along a curved slide surface adapted to the curve. One edge of the folded-box sleeve is hereby pressed against the slide surface.

When the output device has lugs, the lug surface of which corresponds with respect to its alignment to a sidewall of a partially unfolded folded-box sleeve, then the lug surface rests flat on the sidewall during the removal of the folded-box sleeve from the chute, thus does not press said sidewall in and does not influence the unfolding state of the folded-box sleeve.

A very good independent unfolding of the folded box in the expansion chamber occurs when the folded-box sleeve is still lacking 20 to 25 degrees until right angles on its inside are reached. A flat bearing of the lug surface on the sidewall is given for this case when a corresponding angle of 20 to 25 degrees is provided between the lug surface and a normal to a moving endless strand of the output device.

When a first device for forwarding of the fully unfolded folded-box sleeves is provided at the expansion chamber, it is then possible to feed with the device the folded-box sleeves from the expansion chamber to a filling and closing station. When the first device is driven at the same speed as a second device for forwarding, which second device follows the output device, it is then possible for the unfolded folded boxes to be forwarded in a reliable manner simultaneously by lugs of both devices. The forwarding occurs hereby in a careful manner when lugs of both devices hold the folded boxes at diagonally opposite edges of the folded boxes.

BRIEF DESCRIPTION OF THE DRAWING

The invention will be described in greater detail in connection with one FIGURE, which illustrates one exemplary embodiment and shows.

DETAILED DESCRIPTION

Figure 1:
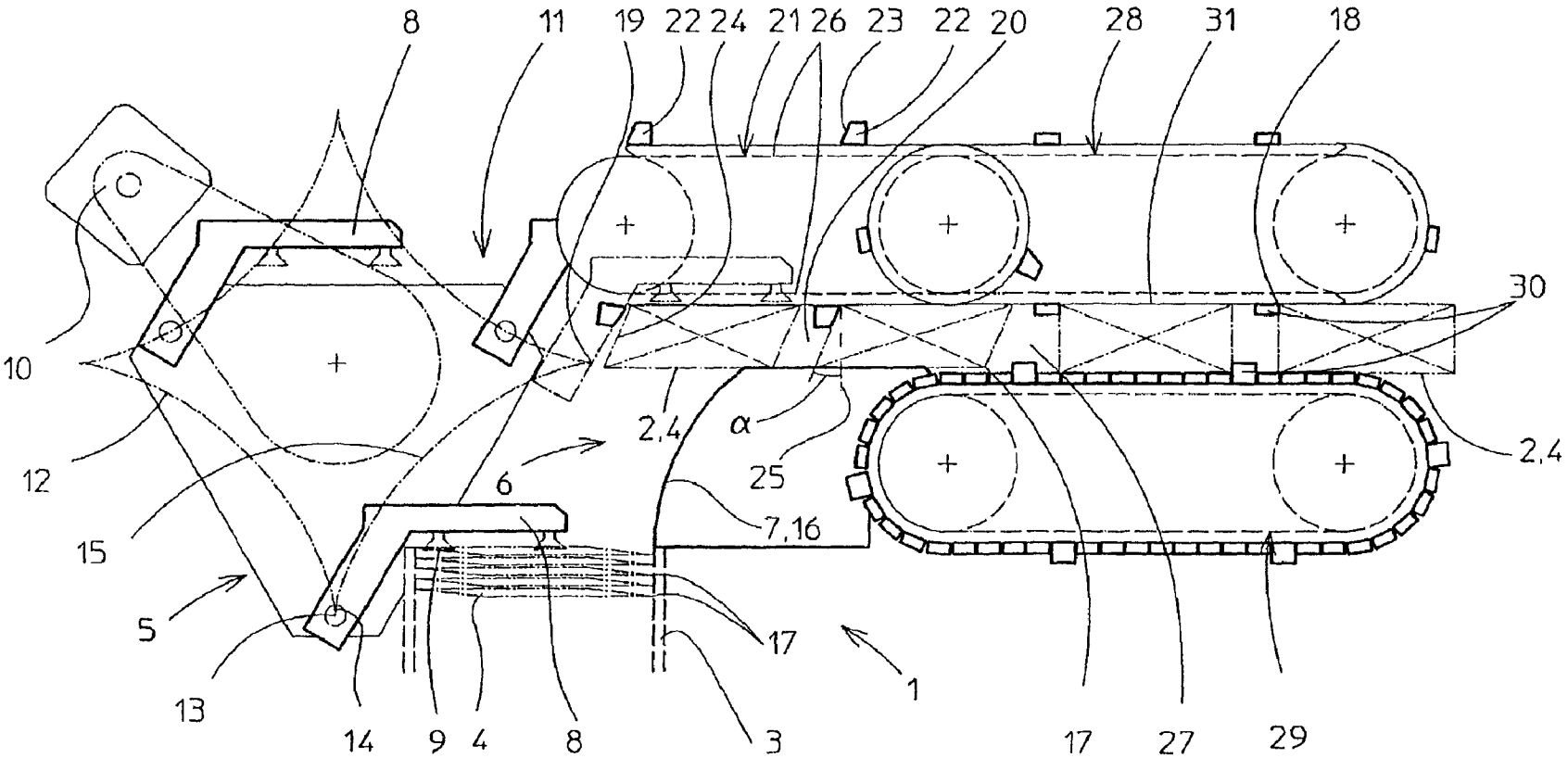
FIG. 1 is a top plan view of a device for unfolding folded boxes, comprising a three-arm removing device for the individual removal of flat folded-box sleeves from a magazine and for moving the folded-box sleeves along a curved slide surface in order to only partially unfold the folded-box sleeves, a chute to receive the incompletely unfolded folded-box sleeves, and an expansion chamber following the chute, in which expansion chamber the folded-box sleeves unfold automatically fully due to their internal stresses.

A device 1 for unfolding of folded boxes 2 has a magazine 3, in which the prefolded, flat and closed folded-box sleeves 4 are stored. A removing device 5 is used to individually remove the folded-box sleeves 4 from the magazine 3 and to feed the folded-box sleeves 4 to an unfolding device 6 where the folded-box sleeves 4 are unfolded only partially initially along a compressing section 7.

The removing device 5 has three arms 8 each with suction heads 9. It is moved by a drive 10 and a planetary gearing 11 so that reference points 13 of the arms 8 describe a cycloidal path 12. One flat folded-box sleeve 4 is thereby removed from the magazine 3 starting at the point 14 of the cycloidal path 12. Along a curve 15 of the cycloidal path 12 occurs a partial unfolding of the flat folded-box sleeves 4 through compression on a curved slide surface 16 on which the folded-box sleeves 4 are moved along with pressure on one of the respective edges 17. A further point 19 of the cycloidal path 12 is provided at the end of this compressing section 7 in order to guide the folded-box sleeves 4 into a chute 20. The chute 20 provides for a precisely fitting receipt of the only partially unfolded folded-box sleeves 4.

The folded-box sleeves 4 keep their form in the chute 20 and reduce a part of the occurring stress. An output device 21 is provided to move the folded-box sleeves 4 through the chute 18. The output device 21 has lugs 22 each with a lug surface 23 inclined in the same direction as the sidewall 24 of the folded box 2 engaged therewith. An angle α of 22 degrees exists between the lug surface 23 and a normal 25 to a moving strand 26 of the output device 21.

An expansion chamber 27 follows the chute 20 to receive the partially unfolded-box sleeves 4, which unfold further threat due to the box sleeve's residual internal stress and become rectangular unfolded boxes 2. Two rotating devices 28, 29 are provided at the expansion chamber 27 to forward the fully unfolded folded-box sleeves 4. The output device 21 and these two devices 28, 29 hold the unfolded boxes 2 at diagonally opposite edges 17, 18 in order to forward the unfolded boxes 2 along a slide surface 31 to a filling and closing station.

List of Reference Numerals

1 Device
2 folded box
3 magazine
4 folded-box sleeve
5 removing device
6 unfolding device
7 compressing section
8 arm
9 suction head
10 drive
11 planetary gearing
12 cycloidal path
13 reference point
14 point
15 curve
16 slide surface
17 edge
18 edge
19 point
20 chute
21 output device
22 lug
23 lug surface
24 sidewall
25 normal
26 strand
27 expansion chamber
28,29 device for forwarding
30 lug
31 slide surface

We claim:

1. A device for unfolding of folded boxes, comprising a magazine for receiving of flat folded-box sleeves, a removing device for individual removal of the folded-box sleeves from the magazine and for feeding the folded-box sleeves to an unfolding device wherein the folded-box sleeves are partially unfolded along a compressing section, the unfolding device including, after the compressing section, a chute for precise fitting receipt of the partially unfolded folded-box sleeves, an output device for removing the partially unfolded-box sleeves from the chute, the output device including lugs each said lug having a lug surface configured to align with a sidewall of the partially unfolded folded-box sleeves, each said lug having an angle (α) in a range of 20 to 25 degrees defined by the lug surface and a normal perpendicular to a path of travel of the partially unfolded folded-box sleeves in the chute, an expansion chamber following the chute whereat the partially unfolded folded-box sleeves are fully unfolded, and first and second devices provided at the expansion chamber and operated at the same speed to hold the fully unfolded box sleeves at diagonally opposite edges and to forward the fully unfolded box sleeves.

2. The device according to claim 1, wherein the removing device includes several arms having suction heads, and the arms are movable by a drive and a planetary gearing along a cycloidal path.

3. The device according to claim 1, wherein the compressing section is defined by a curved slide surface along which the folded-box sleeves are moved.

4. The device according to claim 1, wherein the output device comprises a conveyor.

5. The device according to claim 1, wherein the first and second devices provided at the expansion chamber comprise first and second conveyors for forwarding the fully unfolded box sleeves.

6. A device for unfolding of folded-box sleeves, comprising:

a magazine for receiving a plurality of stacked folded-box sleeves;

a removing device having a plurality of arms with suction cups moving through a drive and through a planetary gearing along a cycloidal path having points and curves, said arms sequentially removing one of the folded-box sleeves from the magazine;

a compressing section for compressing the folded-box sleeves when said removing device moves the folded-box sleeves therealong to only partially unfold the folded-box sleeves, the compressing section comprising a curved slide surface, wherein the curved slide surface presses against an edge of the folded-box sleeve and partially unfolds the folded-box sleeve while the arm carrying the folded-box sleeve moves along a curve of the cycloidal path, and the curved slide surface is adapted to the curvature and distance of the cycloidal path in order to accomplish the compressing and partial unfolding of the folded-box sleeve;

a chute dimensioned to precisely receive the only partially unfolded box sleeves;

an output device for removing the only partially unfolded box sleeves from the removing device and advancing the partially unfolded box sleeves from the chute;

an expansion chamber following the chute for receiving the partially unfolded box sleeves from the chute; and first and second rotating devices for receiving the only partially unfolded box sleeves and fully unfolding the partially unfolded box sleeves, said first and second rotating devices forwarding the fully unfolded box sleeves from the expansion chamber.

7. The device according to claim 6, wherein the output device includes lugs having lug surfaces for contacting the partially unfolded box sleeves, the lugs defining an angle of 20 degrees to 25 degrees from normal to align with a sidewall of the partially unfolded folded-box sleeves.

8. A method for unfolding folded boxes, comprising:

providing a plurality of stacked folded-box sleeves in a magazine;

sequentially removing one of the folded-box sleeves from a magazine with a removing device having a plurality of arms with suction cups;

advancing one of the folded-box sleeves supported by one of the plurality of the arms with the suction cups;

compressing the folded-box sleeve during advancement along a compressing section comprising a curved slide surface to only partially unfold the folded-box sleeve;

advancing the only partially unfolded folded-box sleeve with the one of the plurality of the arms into a chute;

removing the only partially unfolded folded-box sleeve from the one of the plurality of the arms using first conveyor without significant unfolding of the partially unfolded folded-box sleeve;

advancing the partially unfolded box sleeve from the chute using the first conveyor without further significant unfolding into an expansion chamber following the chute using the conveyor; and fully unfolding the partially unfolded box sleeve in the expansion chamber utilizing second and third conveyors;

forwarding the fully unfolded box sleeve from the expansion chamber using the second and third conveyors; and repeating the above steps for additional folded-box sleeves by the removing of folded-box sleeves from the magazine sequentially utilizing the plurality of arms.

9. The method according to claim 8, wherein the step of compressing the folded-box sleeve during advancement along a compressing section comprises compressing the folded-box sleeve against a curved slide surface at an initial force and velocity enabling only the partial unfolding of the folded-box sleeve.

10. The method according to claim 8, wherein the step of advancing the partially unfolded box sleeve from the chute without further unfolding the partially unfolded box sleeve comprises contacting the partially unfolded box sleeves with lugs of the output device, the lugs defining an angle of 20 degrees to 25 degrees from normal to align with a wall of the partially unfolded folded-box sleeve.

11. A device for unfolding of folded-box sleeves, comprising:

a magazine for receiving a plurality of stacked folded-box sleeves;

a removing device having a plurality of arms with suction cups, said arms sequentially removing one of the folded-box sleeves from the magazine;

a compressing section for compressing the folded-box sleeves when said removing device moves the folded-box sleeves therealong to only partially unfold the folded-box sleeves, the compressing section comprising a curved slide surface;

a chute dimensioned to precisely receive the only partially unfolded box sleeves;

an output device for removing the only partially unfolded box sleeves from the removing device and advancing the partially unfolded box sleeves from the chute;

an expansion chamber following the chute for receiving the partially unfolded box sleeves from the chute; and first and second conveyors for receiving the only partially unfolded box sleeves and fully unfolding the partially unfolded box sleeves, said first and second conveyors forwarding the fully unfolded box sleeves from the expansion chamber.

12. A device for unfolding of folded-box sleeves, comprising:

a magazine for receiving a plurality of stacked folded-box sleeves;

a removing device having a plurality of arms with suction cups, said arms sequentially removing one of the folded-box sleeves from the magazine;

a compressing section for compressing the folded-box sleeves when said removing device moves the folded-box sleeves therealong to only partially unfold the folded-box sleeves, the compressing section comprising a curved slide surface;

a chute dimensioned to precisely receive the only partially unfolded box sleeves;

an output conveyor for removing the only partially unfolded box sleeves from the removing device and advancing the partially unfolded box sleeves from the chute;

an expansion chamber following the chute for receiving the partially unfolded box sleeves from the chute; and a rotating conveyor and a rotating device for receiving the only partially unfolded box sleeves and fully unfolding the partially unfolded box sleeves, wherein said output and rotating conveyors are adjacent each other and aligned in series to advance the box sleeves along a substantially linear path, and wherein said rotating conveyor and said rotating device forward the fully unfolded box sleeves from the expansion chamber.

13. A device for erecting folding boxes, comprising:

a loader for holding flat folding-box sleeves, an extractor for extracting the folding-box sleeves singly from the loader and for feeding the folding-box sleeves to an erecting device in which the folding-box sleeves are erected along a curved sliding surface defining a compression section, the erecting device comprising a duct following the compression section for holding only partially erected folding-box sleeves in an exact fit, a removal device for removing the folding-box sleeves from the duct, and an expansion space adjoining the duct for holding fully erected folding-box sleeves, wherein the extractor comprises several arms with suction cups for gripping a folding-box sleeve, the arms are movable through a drive and a planetary gear along a cycloidal path having peaks and curves, wherein the curved sliding surface presses against an edge of the folded-box and partially unfolds a folding-box sleeve while the arm carrying the folding-box sleeve is moved along a curve of the cycloidal path, and wherein the curved sliding surface is adapted to the curvature and distance of the cycloidal path in order to achieve the compression and thus the partial erection of the folding-box sleeve.

14. The device according to claim 13, wherein the removal device comprises drivers, a driving surface of which corresponds with respect to its orientation to the orientation of a sidewall of the partially erected folding-box sleeve.

15. The device according to claim 14, wherein an angle ($\alpha$) of 20 to 25 degrees is provided between the driving surface and a vertical to a circulating belt of the removal device.

16. The device according to claim 12, including a first rotating device for transferring the fully erected folding-box sleeves provided at the expansion space.

17. The device according to claim 16, wherein the first rotating device is operated at a same speed as a second rotating device for transferring that adjoins the removal device.

18. The device according to claim 17, wherein drivers of the first and second rotating devices hold the folding boxes at diagonally opposite edges of the folding boxes.

* * * * *

UNITED STATES PATENT AND TRADEMARK OFFICE

CERTIFICATE OF CORRECTION

PATENT NO. : 6,872,176 B2
DATED : March 29, 2005
INVENTOR(S) : Thomas Wyss et al.

It is certified that error appears in the above-identified patent and that said Letters Patent is hereby corrected as shown below:

Column 5,
Line 18, change "using the conveyor" to -- using the first conveyor --.

Column 6,
Line 57, change "according to Claim 12" to -- according to Claim 21 --.

Signed and Sealed this

Thirteenth Day of September, 2005

JON W. DUDAS
*Director of the United States Patent and Trademark Office*